US009598192B2

(12) United States Patent
Yoshikane

(10) Patent No.: US 9,598,192 B2
(45) Date of Patent: Mar. 21, 2017

(54) BAG MOUTH OPENING METHOD AND APPARATUS FOR USE IN BAG FILLING AND PACKAGING

(71) Applicant: Toyo Jidoki Co., Ltd., Minato-ku, Tokyo (JP)

(72) Inventor: Tohru Yoshikane, Iwakuni (JP)

( * ) Notice: Subject to any disclaimer, the term of this patent is extended or adjusted under 35 U.S.C. 154(b) by 775 days.

(21) Appl. No.: 13/963,874

(22) Filed: Aug. 9, 2013

(65) Prior Publication Data

US 2014/0102045 A1 Apr. 17, 2014

(30) Foreign Application Priority Data

Oct. 12, 2012 (JP) ..... 2012-226812

(51) Int. Cl.
*B65B 43/46* (2006.01)
*B65B 43/50* (2006.01)
(Continued)

(52) U.S. Cl.
CPC ..... *B65B 43/465* (2013.01); *B65B 3/045* (2013.01); *B65B 43/50* (2013.01); *B65B 39/00* (2013.01);
(Continued)

(58) Field of Classification Search
CPC ..... B65B 43/262; B65B 43/28; B65B 43/30; B65B 43/465; B65B 43/48; B65B 43/50;
(Continued)

(56) References Cited

U.S. PATENT DOCUMENTS 5,606,844 A * 3/1997 Takagaki ..... B29C 65/08 53/133.2
6,810,636 B2 * 11/2004 Resterhouse ..... B29C 65/02 493/210
(Continued)

FOREIGN PATENT DOCUMENTS

| | | |
|---|---|---|
| CN | 102211671 A | 10/2011 |
| EP | 1693186 A1 | 8/2006 |
| JP | 3261543 | 12/2001 |

*Primary Examiner* — Stephen F Gerrity
*Assistant Examiner* — Joshua Kotis
(74) *Attorney, Agent, or Firm* — Daniel P. Burke & Associates, PLLC

(57) ABSTRACT

Provided are a bag mouth opening method and apparatus capable of surely and stably opening into a desired shape the mouth of a spout bag having a spout attached to an upper edge-side portion thereof. A spout tilting relative to a bag is corrected into a non-tilting position and pinched with spout pinching members opened and closed by a first air cylinder of a spout holding device. The first air cylinder is held in an initial position in the width direction of the bag by a second air cylinder through a quadric link comprising a connecting rod mounting plate, a connecting rod, a connecting plate, and a second support arm. The interior of the second air cylinder is opened to the atmospheric pressure in synchronism with the start of movement away from each other of a pair of suction cups of a bag mouth opening device and movement toward each other of a pair of gripping members gripping the laterally opposite side edges of the bag. Consequently, the first air cylinder and the pinching members attached thereto become free to move in the width direction of the bag and thus are moved through the bag in accordance with the movement of the gripping members.

7 Claims, 7 Drawing Sheets

(51) Int. Cl.

| | |
|---|---|
| ***B65B 3/04*** | (2006.01) |
| *B65B 39/00* | (2006.01) |
| *B65B 43/44* | (2006.01) |
| *B65B 51/10* | (2006.01) |
| *B65B 51/32* | (2006.01) |
| *B65B 61/02* | (2006.01) |

(52) U.S. Cl.
CPC ..... *B65B 43/44* (2013.01); *B65B 51/10* (2013.01); *B65B 51/32* (2013.01); *B65B 61/025* (2013.01)

(58) Field of Classification Search
CPC ..... B65B 43/54–43/60; B65B 3/045; B65B 3/17; B65B 7/025; B65B 7/14; B65B 61/186; B65B 1/18
USPC ..... 53/133.1, 133.2, 386.1, 570–571, 284.7
See application file for complete search history.

(56) References Cited

U.S. PATENT DOCUMENTS 7,121,428 B2 * 10/2006 Hiramoto ..... B31B 19/84 221/210
7,469,522 B2 * 12/2008 Dettwiller ..... B65B 3/02 53/133.1
7,677,013 B2 * 3/2010 Nagano ..... B31B 1/84 493/87
2001/0015056 A1 * 8/2001 Hiramoto ..... B29C 65/18 53/479
2004/0139704 A1 * 7/2004 Savage ..... B65B 3/045 53/469
2006/0189466 A1 * 8/2006 Tsutsui ..... B31B 1/80 493/206
2006/0199716 A1 * 9/2006 Tsutsui ..... B29C 65/18 493/87
2007/0089377 A1 * 4/2007 Yasuhira ..... B65B 43/465 53/403
2009/0188209 A1 * 7/2009 Koga ..... B65B 1/06 53/53
2009/0233778 A1 * 9/2009 Tsutsui ..... B65B 3/02 493/212
2009/0241475 A1 * 10/2009 Tsutsui ..... B65B 61/186 53/459
2010/0192367 A1 * 8/2010 Kishimoto ..... B31B 19/84 29/773
2011/0138751 A1 * 6/2011 Nakagawa ..... B65B 43/50 53/469

* cited by examiner

BAG MOUTH OPENING METHOD AND APPARATUS FOR USE IN BAG FILLING AND PACKAGING

BACKGROUND OF THE INVENTION

Technical Field

The present invention relates to a bag mouth opening method and apparatus for use in bag filling and packaging in which a bag is held in a suspended position by being gripped at its laterally opposite side edges with a pair of grippers (left and right grippers) movable toward and away from each other, and the bag held in this way is moved along a predetermined path to open the bag mouth, fill an article to be packaged into the bag from the opened bag mouth, and seal the bag mouth in the course of the movement. More particularly, the present invention relates to a method of and apparatus for opening a mouth portion of a bag having a spout attached to an upper edge-side portion thereof, which is called a spout bag.

Background Art

Spout bags may be used in packaging of liquid material, for example. A bag filling and packaging machine disclosed in Japanese Patent No. 3,261,543 shows one example of packaging using spout bags. The bag filling and packaging machine successively carries out the following packaging processes: feeding the packaging machine with a bag having no spout attached thereto (first step); attaching a spout to the bag (third and fourth steps); opening the bag mouth (fifth step); filling an article to be packaged into the bag (sixth step); sealing the bag mouth (seventh and eighth steps); and so forth. There is also known a bag filling and packaging process in which a bag having a spout attached thereto previously is fed to a bag filling and packaging machine, in which are successively carried out opening the bag mouth, filling an article to be packaged, sealing the bag mouth, etc.

In bag filling and packaging, the bag mouth needs to be opened surely and stably for the following reasons. If the bag mouth cannot be opened in a desired shape or the opened bag mouth cannot be stably kept in the desired shape, the process of filling an article to be packaged may be hindered, for example, by an error in insertion of a liquid material-filling nozzle into the bag. There are bags having a spout attached to an upper edge-side portion thereof, e.g. a corner spout bag having a spout attached to an upper end corner thereof as shown in FIG. 5*a* of Japanese Patent No. 3,261,543, and a bag having a spout attached thereto at a position predetermined distance rightward or leftward from the upper end center of the bag as shown in FIG. 5*b* of the same Japanese Patent No. 3,261,543.Such spout bags are provided with an opening for filling an article to be packaged at a position different from but relatively close to the position where the spout is attached. Therefore, there may be a hindrance to the operation of opening the bag mouth with an opening device generally using suction cups More specifically, a bag is flat on the whole before being opened at the mouth thereof. Therefore, a spout bag having a spout attached to the top thereof, particularly a corner spout bag, involves the following problem. As shown in FIGS. 1A, 1B and 1C, which are a front view, a plan view, and a side view, respectively, the spout S undesirably tilts by gravity above the grippers G gripping the bag B, causing the bag body Bb to bend at the periphery of the position where the spout S is attached (i.e. at the periphery of the bag mouth). In such a case, there may be an error in the operation of opening the bag mouth using the suction cups C. Even if the bag mouth can be opened, the opened bag mouth may fail to stably keep a desired shape, which may give rise to a problem in the process of filling an article to be packaged, which is carried out afterward. This problem remarkably occurs in the case of a bag that is thin in thickness of the film constituting the bag body and hence that is not very stiff.

SUMMARY OF THE INVENTION

The present invention has been made in view of the above-described problems associated with the background art.

Accordingly, an object of the present invention is to provide a bag mouth opening method and apparatus capable of surely and stably opening into a desired shape the mouth of a spout bag having a spout attached to an upper edge-side portion thereof.

The present invention provides a bag mouth opening method for use in bag filling and packaging in which a spout bag having a spout attached to an upper edge-side portion thereof and having a bag mouth formed at an upper edge thereof adjacently to the spout is held in a suspended position by being gripped at its laterally opposite side edges with a pair of gripping members and moved along a predetermined path to open the bag mouth, fill an article to be packaged into the bag, and seal the bag mouth. The method includes a spout holding step of holding the spout with a spout holding member to keep the spout upright without a tilt relative to a plane in which the bag extends, and a bag mouth opening step of causing a pair of suction-adhering members to suction-adhere to and hold the opposite side walls of the bag and moving the suction-adhering members away from each other with the suction-adhering members kept suction-adhering to the opposite sides walls of the bag, while moving the pair of gripping members toward each other and moving the spout holding member toward the bag mouth.

In the bag mouth opening method, the spout holding member may have pinching members disposed at the opposite sides of the bag and movable toward and away from each other, so that, in the spout holding step, the spout is pinched with the pinching members in the thickness direction of the bag.

Further, in the bag mouth opening method, when the pinching members move from respective mutually distant standby positions to pinching positions to pinch the spout in the spout holding step, the pinching members may engage the spout, which may be tilting relative to the plane in which the bag extends, to correct the spout into a non-tilting position.

Further, the bag mouth opening method may be arranged as follows. In the bag mouth opening step, the spout holding member is made free to move in the width direction of the bag, so that the spout holding member moves in the width direction of the bag in response to movement of an upper edge portion of the bag adjacent to the bag mouth as the bag mouth opens.

Further, in the bag mouth opening method, the bag may be a corner spout bag.

In addition, the present invention provides a bag mouth opening apparatus for use in a bag filling and packaging machine in which a spout bag having a spout attached to an upper edge-side portion thereof and having a bag mouth formed at an upper edge thereof adjacently to the spout is moved along a predetermined path to open the bag mouth, fill an article to be packaged into the bag, and seal the bag mouth. The apparatus has a plurality of pairs of gripping members, each pair comprising left and right gripping members movable toward and away from each other, the gripping members gripping the laterally opposite side edges of the bag in a suspended position and moving along the predetermined path, a bag mouth opening device having suction-adhering members disposed at the opposite sides of the bag and movable toward and away from each other to suction-adhere to and hold the opposite side walls of the bag, and a spout holding device holding the spout. The spout holding device has a pair of spout pinching members disposed at the opposite sides of the bag and movable toward and away from each other to pinch the spout by moving toward each other, a pinching member opening-closing device moving the pair of spout pinching members toward and away from each other, and a pinching member moving device holding the spout pinching members at a predetermined initial position and allowing the spout pinching members to move in the width direction of the bag.

The bag mouth opening apparatus may be arranged as follows. When the pair of spout pinching members move from respective mutually distant standby positions to respective pinching positions to pinch the spout, one of the pair of spout pinching members engages the spout, which may be tilting relative to a plane in which the bag extends, to correct the spout into a non-tilting position Further, in the bag mouth opening apparatus, the pinching member moving device may have an air cylinder. The air cylinder holds the spout pinching members at the predetermined initial position in the width direction of the bag. In synchronism with the start of movement of the gripping members toward each other, the interior of the air cylinder is opened to the atmospheric pressure to make the spout pinching members free to move in the width direction of the bag.

Further, in the bag mouth opening apparatus, the plurality of pairs of gripping members may be provided on an intermittently rotating rotary table at equal spaces in the circumferential direction of the rotary table.

Further, in the bag mouth opening apparatus, the bag mouth opening device and the spout holding device may be provided at a bag mouth opening station set along the circumferential direction of the rotary table at a predetermined position among a plurality of positions at which the bag stops when the rotary table intermittently stops.

Further, in the bag mouth opening apparatus, the spout bag may be a corner spout bag.

As has been stated above, in the present invention, the spout tilting relative to the bag is corrected into a non-tilting position and held in this position before the bag mouth is opened, and the bag mouth is opened while keeping the spout in the non-tilting position. Therefore, it is possible to prevent the occurrence of an error in opening the bag mouth and to open the bag mouth into a desired shape stably. Even when the spout is released from the hold after the bag mouth has been opened, the bag assumes a three-dimensional configuration on the whole because the bag mouth has been opened, and thus the bag has increased shape retention (stiffness). Accordingly, the normal mouth open state of the bag is maintained, and it is therefore possible to prevent an error in filling an article to be packaged into the bag.

According to one aspect of the present invention, when the spout pinching members are moved from the respective standby positions to the respective pinching positions, either of the pinching members engages the spout, which may be tilting relative to the bag, to correct the spout into a non-tilting position. With this arrangement, it is unnecessary to separately provide a member for correcting the position of the spout before pinching the spout.

According to another aspect of the present invention, when the bag mouth is opened after the spout has been held, the spout pinching members are moved together with the spout moving in accordance with the change in shape of the bag mouth, i.e. the spout pinching members are moved through the bag in the width direction of the bag. With this arrangement, the spout pinching members can surely follow the mutually approaching movement of the gripping members. Therefore, the bag mouth can be opened surely and stably. In addition, because the spout pinching members are moved through the bag by the mutually approaching movement of the gripping members, the speed (production speed) of the bag filling and packaging machine can be changed without the need to make adjustments otherwise required. Accordingly, operability improves.

Other objects and advantages of the present invention will become apparent from the following detailed description of illustrated embodiments of the invention.

DETAILED DESCRIPTION OF THE PREFERRED EMBODIMENTS

Figure 1B:
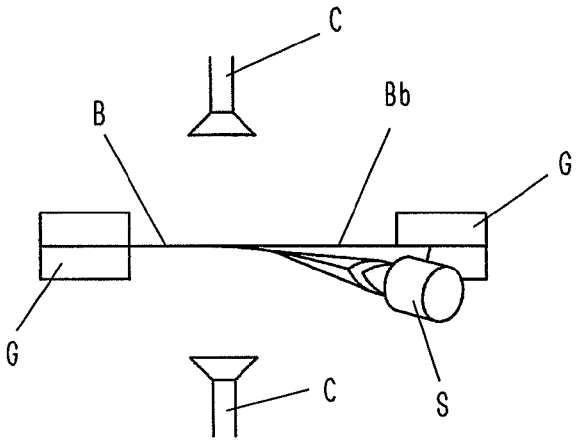
FIGS. 1A, 1B and 1C are a front view, a plan view, and a side view, respectively, illustrating the way in which a spout bag is gripped with a pair of grippers according to the conventional related art.
Figure 1A:
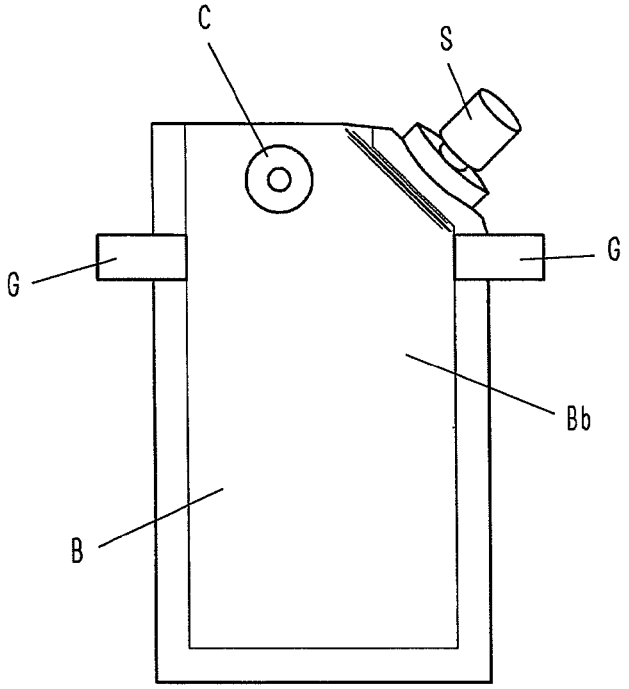
Figure 1C:
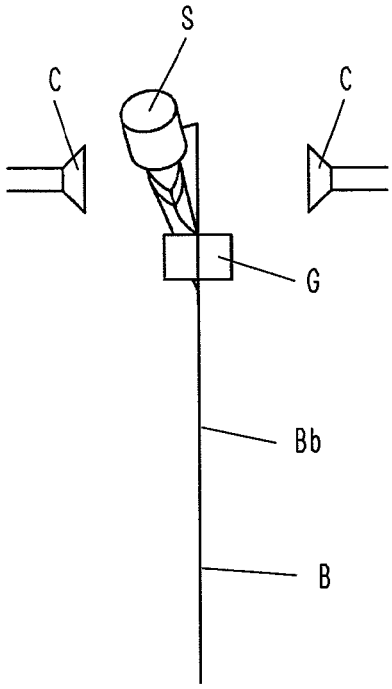
Figure 2:
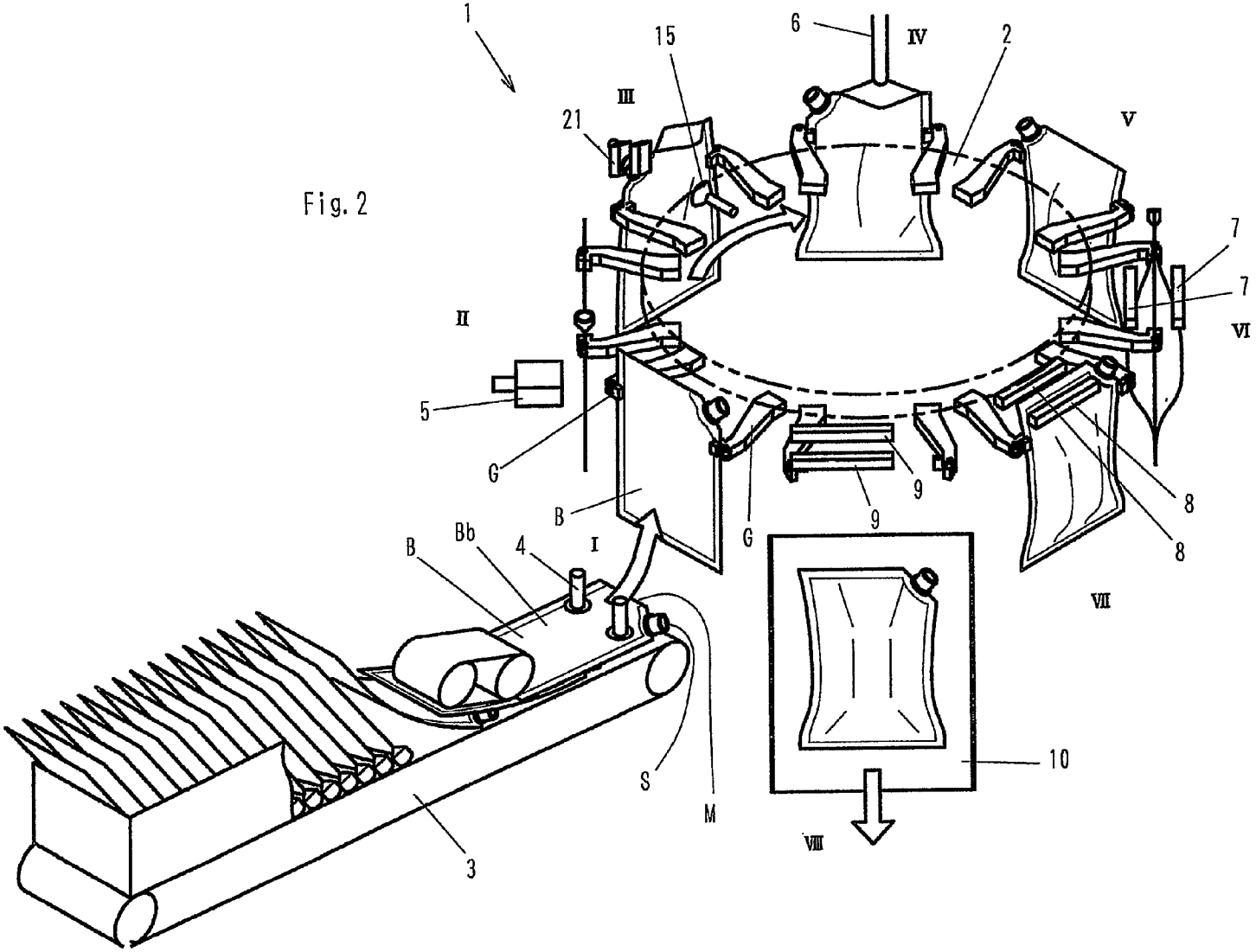
FIG. 2 is a perspective view schematically showing the structure of a bag filling and packaging machine equipped with a bag mouth opening apparatus according to the present invention.

The bag mouth opening method and apparatus of the present invention will be described below with reference to the accompanying drawings. FIG. 2 is a perspective view showing the structure of a bag filling and packaging machine equipped with a bag mouth opening apparatus according to the present invention. It should be noted that the present invention will be explained below by way of an example in which the present invention is applied to an intermittently rotating bag filling and packaging machine in which grippers for gripping bags are attached to an intermittently rotating table. The application of the present invention, however, is not limited thereto. The path along which the grippers are moved is not limited to a circular path but may be a rectilinear or racetrack-shaped path. The movement of bags along the path is not limited to the intermittent rotation but may be a continuous movement.

In FIG. 2, reference numeral 1 denotes an intermittently rotating bag filling and packaging machine (hereinafter referred to as simply "packaging machine") having a rotary table 2 (hereinafter referred to as simply "table 2") intermittently rotating in the direction of the arrow shown in the figure. The table 2 is provided with a plurality of pairs of grippers G at predetermined spaces in the circumferential direction. Each gripper pair comprises left and right grippers G. The grippers G hold a bag B in a suspended position by gripping the laterally opposite side edges thereof, and move the bag B along a circular path in accordance with the rotation of the table 2. While the bag B is being moved, various bag filling and packaging operations are performed by various devices properly provided at stations set at respective predetermined positions around the table 2.

At the station I, a bag feeding step is carried out. Bags B are corner spout bags. Each bag B has a spout S attached to a corner of the upper edge of a bag body Bb and has a bag mouth M for filling an article to be packaged. The bag mouth M is provided at the upper edge of the bag body Bb adjacently to the spout S. Reference numeral 3 denotes a conveyor magazine. Bags B are successively delivered from the conveyor magazine 3 to the grippers G by a bag feeding device having a pair of suction cups 4. The station II performs a printing step, at which each bag B is printed with the date of manufacture, etc. by using a printer 5. The station III performs a bag mouth opening step. At the station III are installed a bag mouth opening device 15 and a spout holding device 21, which will be detailed later. The station IV performs a bag filling step. At the station IV, a liquid material to be packaged is filled into the bag B by using a nozzle 6. The station V is vacant. At the station V, no particular processing is carried out, but the pair of grippers (left and right grippers) G move away from each other to bring the bag mouth M into a tensed state. The station VI performs primary sealing for the bag mouth M by using a pair of hot plates 7. The station VII performs secondary sealing by using a pair of hot plates 8. The station VIII performs a cooling-discharging step. At the station VIII, after the bag mouth M has been cooled by using a pair of cooling plates 9, the bag B finished as a product is discharged onto a chute 10. The above-described processing steps, except the bag mouth opening step at the station III, are publicly known, and therefore, a further detailed description thereof is omitted.

Figure 3:
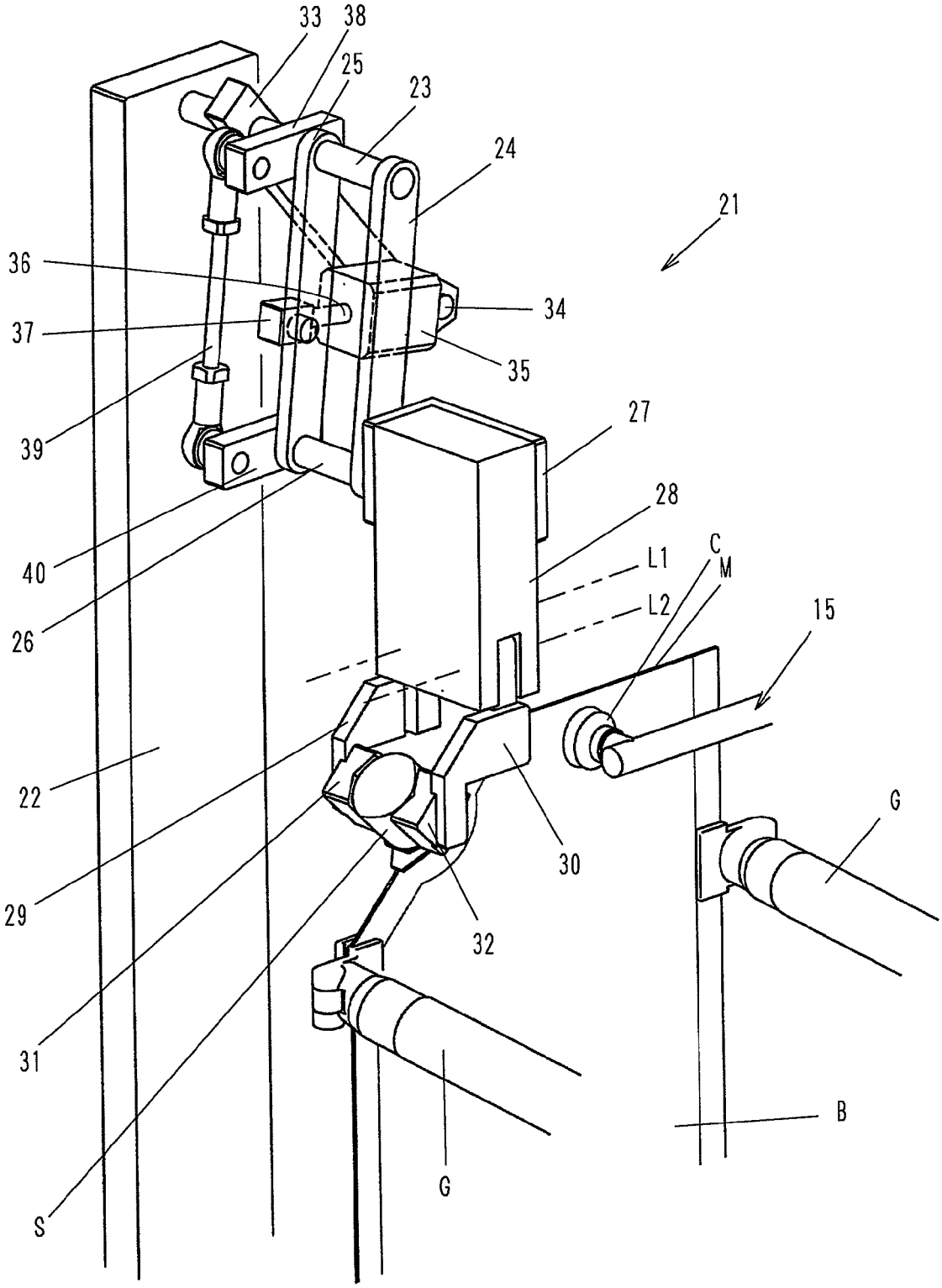
FIG. 3 is a perspective view showing a spout holding device.

Next, the bag mouth opening device 15 and the spout holding device 21, which are used in the bag mouth opening step, will be explained with reference to FIG. 3. The figure shows the state of the station III immediately after a pair of suction cups C have suction-adhered to near the bag mouth M of a corner spout bag B moved to and stopped at the station III, thereby holding the opposite side walls of the bag B, and spout pinching members 29 and 30 have pinched the spout S. The bag mouth opening device 15 used herein is of a conventionally known type. The bag mouth opening device 15 has a pair of suction cups C (only one suction cup C is shown in the figure) arranged to lie at the opposite sides of the bag B moved to the station III. The pair of suction cups C are movable toward and away from each other. Before the bag B moves to the station III, the pair of suction cups C wait at respective positions distant from each other. When the bag B arrives at the station III, the pair of suction cups C move toward each other to respective suction-adhering positions to suction-adhere to and hold the opposite side walls of the bag B. Next, the suction cups C move away from each other by a predetermined distance while suction-adhering to the opposite side walls of the bag B, thereby acting to open the bag mouth M of the bag B. At this time, the grippers G gripping the laterally opposite side edges of the bag B move toward each other. The operations of these mechanisms are publicly known, and therefore, a further description thereof is omitted.

The spout holding device 21 has a stand 22 stood on the top of a machine base (not shown) of the packaging machine 1. The stand 22 has a support shaft 23 fixedly attached to an upper end portion thereof. The support shaft 23 extends toward the bag B perpendicularly to a plane in which the bag B extends. The support shaft 23 has a first support arm 24 and a second support arm 25 that are rotatably attached thereto with a predetermined space therebetween. The first and second support arms 24 and 25 extend downward in parallel to each other. A first bracket mounting shaft 26 is rotatably fitted to the lower ends of the first and second support arms 24 and 25. The opposite ends of the first bracket mounting shaft 26 extend through the first and second support arms 24 and 25 and project to the outsides thereof.

A first bracket 27 having an L-shaped sectional configuration is secured to the distal end of the first bracket mounting shaft 26 projecting from the first support arm 24. A first air cylinder 28 is secured to the first bracket 27 as shown in the figure. The first air cylinder 28 is connected to a compressed air source (not shown). The first air cylinder 28 has two spout pinching members 29 and 30 pivotable in a vertical plane about the respective centers of rotation shown by the two-dot chain lines L1 and L2 in the figure. Pinching portions 31 and 32 provided at the respective distal ends of the spout pinching members 29 and 30 are moved toward and away from each other by the operation of the first air cylinder 28. When the spout pinching members 29 and 30 move toward each other to their respective pinching positions, the pinching portions 31 and 32 pinch the spout S of the bag B from both sides thereof, i.e. in the thickness direction of the bag B. When the spout pinching members 29 and 30 move away from each other to their respective standby positions, the pinching portions 31 and 32 release the spout S. In other words, the first air cylinder 28 is a pinching member opening-closing device that opens and closes the spout pinching members 29 and 30. The respective surfaces of the pinching portions 31 and 32 that abut against the spout S are recessed in a V-shape.

The support shaft 23 has a second bracket 33 fixedly attached thereto at a position closer to the stand 22 than the second support arm 25. The second bracket 33 extends obliquely downward. The second bracket 33 has a shaft 34 provided at the distal end thereof. The shaft 34 extends perpendicular to the second bracket 33. A second air cylinder 35 is supported by the shaft 34 so as to be pivotable in a vertical plane. The second air cylinder 35 has a rod 36 pivotably connected to the second support arm 25 at a lengthwise intermediate portion of the latter through a connecting member 37 secured to the distal end of the rod 36.

Reference numeral 38 denotes a connecting rod mounting plate secured at one end thereof to the support shaft 23 between the second support arm 25 and the second bracket 33. The connecting rod mounting plate 38 extends horizontally in a plane parallel to the plane in which the bag B extends. A connecting rod 39 is pivotably attached at one end thereof to the other end of the connecting rod mounting plate 38. A connecting plate 40 is fixedly attached at one end thereof to the end portion of the first bracket mounting shaft 26 projecting from the second support arm 25. The other end of the connecting rod 39 is pivotably attached to the other end of the connecting plate 40. The distance between the point of connection of the second support arm 25 to the support shaft 23 and the point of connection of the second support arm 25 to the first bracket mounting shaft 26 is equal to the distance between the point of connection of the connecting rod 39 to the connecting rod mounting plate 38 and the point of connection of the connecting rod 39 to the connecting plate 40. The distance between the points of connection of the connecting rod mounting plate 38 to the support shaft 23 and to the connecting rod 39 is equal to the distance between the points of connection of the connecting plate 40 to the first bracket mounting shaft 26 and to the connecting rod 39. Accordingly, the second support arm 25, the connecting rod mounting plate 38, the connecting rod 39, and the connecting plate 40 constitute a quadric link in which the connecting rod mounting plate 38 serves as a fixed link member. Therefore, as the rod 36 of the second air cylinder 35 extends or contracts, the connecting plate 40 moves in the same direction as the direction of the width of the bag B while keeping parallelism to the connecting rod mounting plate 38. Consequently, the first air cylinder 28 and the spout pinching members 29 and 30, which are attached thereto, also move in the same direction as the above while keeping their postures shown in the figure. It should be noted that the point of connection of the second support arm 25 to the first bracket mounting shaft 26 performs a circular-arc motion. Therefore, the first air cylinder 28 slightly moves vertically.

Figure 4B:
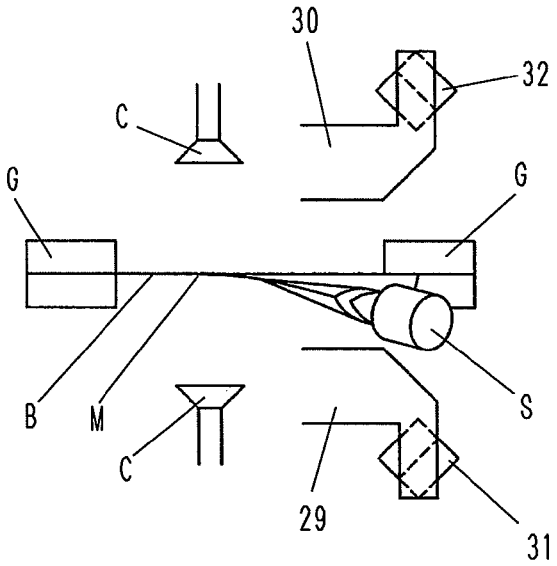
FIGS. 4A, 4B and 4C are a front view, a plan view, and a side view, respectively, illustrating an operation in the bag mouth opening step.
Figure 4A:
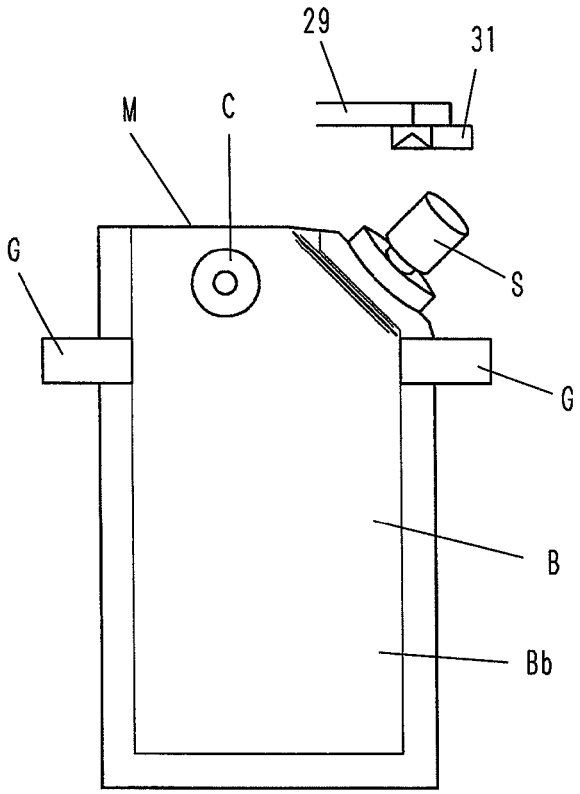
Figure 4C:
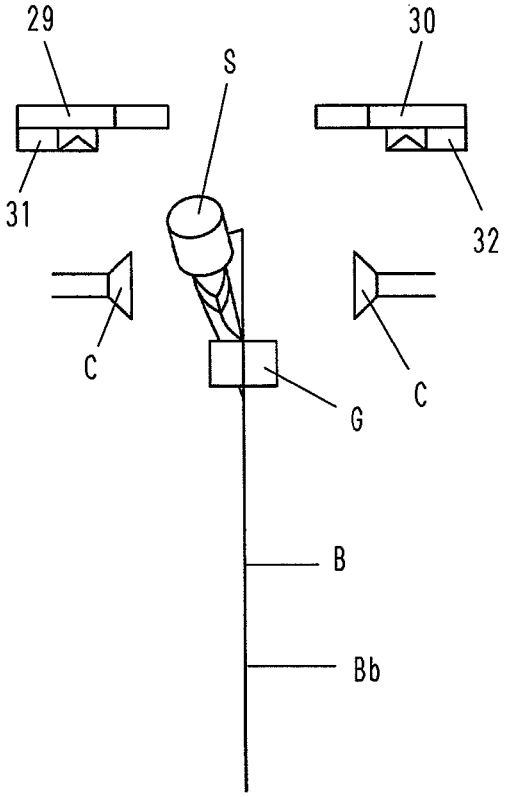

Next, the operations of the various devices at the bag mouth opening step will be explained with reference to FIGS. 4A to 7C. FIGS. 4A, 4B and 4C show the state of the station III immediately after a spout bag B has been moved to and stopped at the station III. The bag B moved to the station III is gripped at its laterally opposite side edges with the grippers G placed at the mutually distant positions. Thus, the bag B is held in a suspended position, with the bag mouth M being still closed. At this time, the spout S often has a tilt toward either of the opposite sides of the bag B, as has been explained in relation to the background art. That is, the spout S is tilting relative to the plane in which the bag B extends. Although in this example the spout S is tilting to the left side in FIG. 4C, the spout S may be tilting to the right side. The suction cups C of the bag mouth opening device 15 are disposed at the opposite sides of the bag B. That is, the suction cups C face each other across the bag B at respective mutually distant positions. The first air cylinder 28 of the spout holding device 21 is being supplied with compressed air to position the spout pinching members 29 and 30 at the respective mutually distant standby positions at the opposite sides of the bag B. The second air cylinder 35 is also being supplied with compressed air, so that the rod 36 extends to hold, through the first and second support arms 24 and 25, the first air cylinder 28 and hence the spout pinching members 29 and 30 at the initial position in the width direction of the bag B.

Figure 5B:
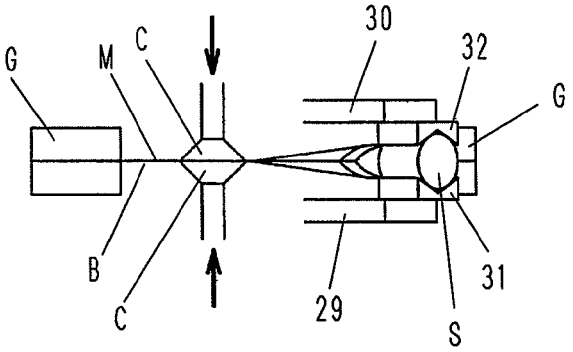
FIGS. 5A, 5B and 5C are a front view, a plan view, and a side view, respectively, illustrating an operation in the bag mouth opening step.
Figure 5A:
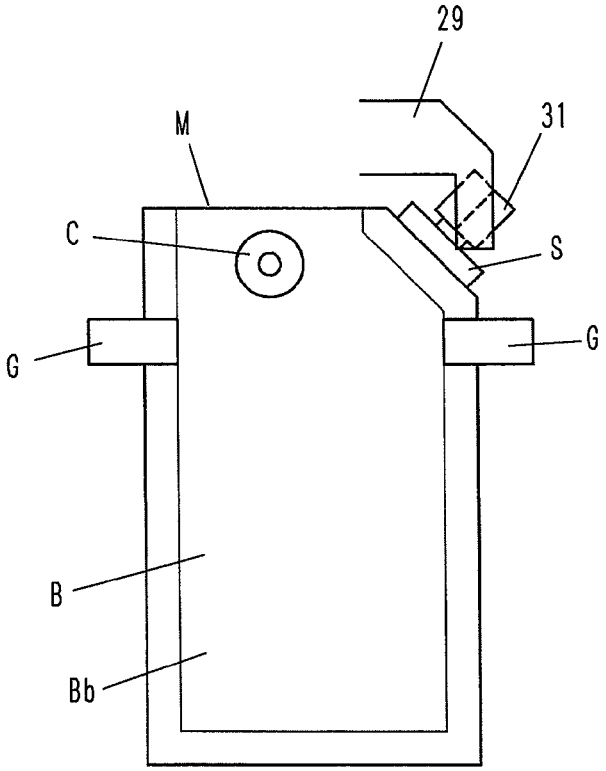
Figure 5C:
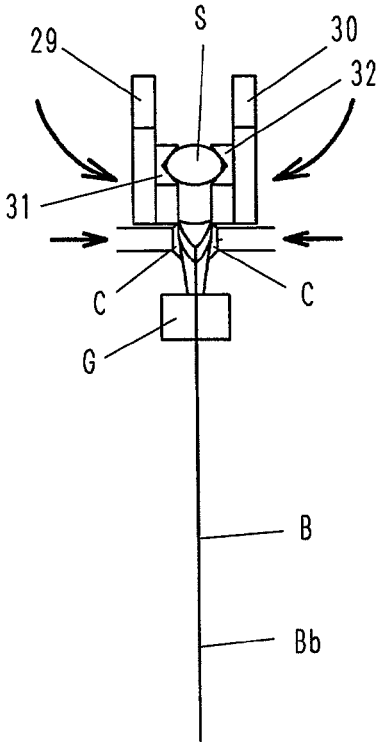

Next, compressed air is applied through a different port of the first air cylinder 28, causing the spout pinching members 29 and 30 to pivot about the respective rotation axes L1 and L2 (see FIG. 3) to the pinching positions in such a manner as to close toward each other as shown by the arrows in FIG. 5C. Consequently, the spout pinching members 29 and 30 pinch the spout S by the pinching portions 31 and 32 (FIGS. 5A, 5B and 5C). At this time, the spout S tilting to the left side in FIG. 4C is corrected in position by the pinching portion 31 of one spout pinching member 29. That is, the pinching portion 31 of the spout pinching member 29 abuts against the tilting spout S and moves so as to correct the position of the spout S. Thus, the spout S is held in the position shown in the figures. At substantially the same time as the operation of the first air cylinder 28, the pair of suction cups C move toward each other from the mutually distant positions to the suction-adhering positions, as shown by the arrows in FIGS. 5B and 5C, to suction-adhere to and hold the opposite side walls of the bag B at a position slightly below the bag mouth M.

Figure 6B:
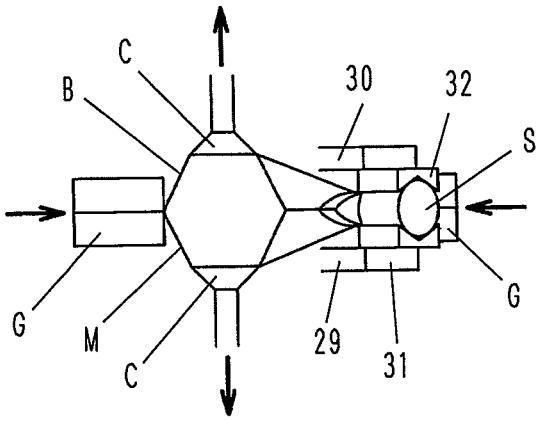
FIGS. 6A, 6B and 6C are a front view, a plan view, and a side view, respectively, illustrating an operation in the bag mouth opening step.
Figure 6A:
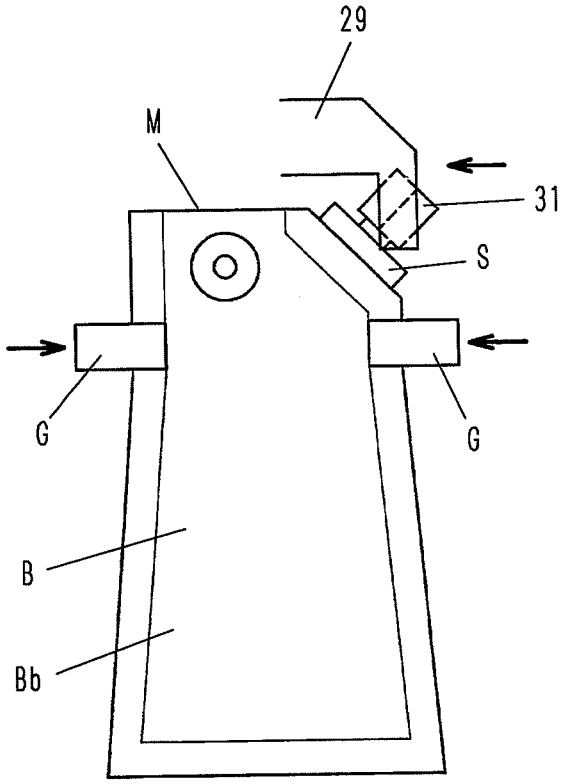
Figure 6C:
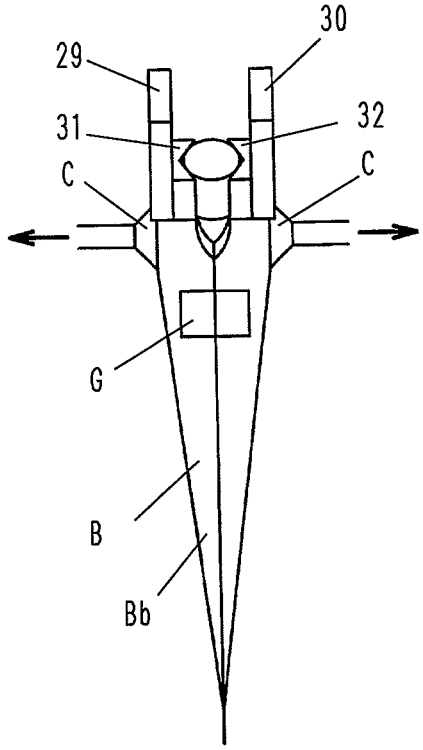

Next, as shown in FIGS. 6A, 6B and 6C, the suction cups C move away from each other to the respective mutually distant positions to open the bag mouth M. At substantially the same time as the bag mouth opening movement of the suction cups C, the left and right grippers G lying at the mutually distant positions move toward each other to respective predetermined mutually close positions so as not to interfere with the bag mouth opening operation performed by the suction cups C and so as to keep the shape of the opened bag mouth M as it is. Further, at substantially the same time as the start of the movements of the suction cups C and the grippers G, the interior of the second air cylinder 35 is opened to the atmospheric pressure. Consequently, no force acts on the rod 36 any longer, and the rod 36 becomes free to extend and contract. Accordingly, the first air cylinder 28 so far held in the initial position by the second air cylinder 35 becomes free to move. Thus, as the right (as seen in FIG. 6A) gripper G moves, the first air cylinder 28 moves to a predetermined bag mouth-side position in the width direction of the bag B in accordance with the change in shape of the bag mouth M, with the spout S being pinched with the spout pinching members 29 and 30. This causes the rod 36 of the second air cylinder 35 to contract. Accordingly, there is no effect on the operation of opening the bag mouth M, and the bag mouth M is opened into a desired shape. It should be noted that the first air cylinder 28 slightly moves vertically when moving toward the bag mouth M, as has been stated above. However, the amount of vertical movement of the first air cylinder 28 is very small. Therefore, the vertical movement of the first air cylinder 28 has no effect on the bag mouth opening operation.

Figure 7B:
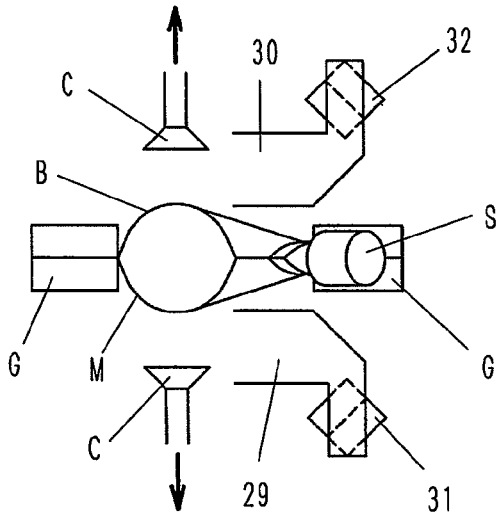
FIGS. 7A, 7B and 7C are a front view, a plan view, and a side view, respectively, illustrating an operation in the bag mouth opening step.
Figure 7A:
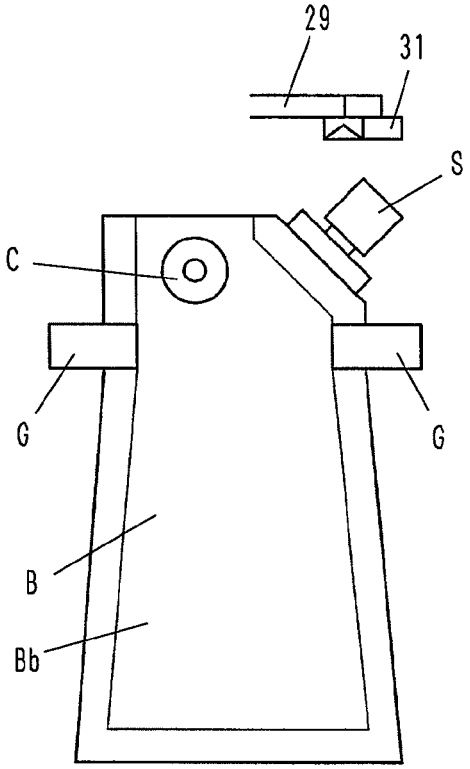
Figure 7C:
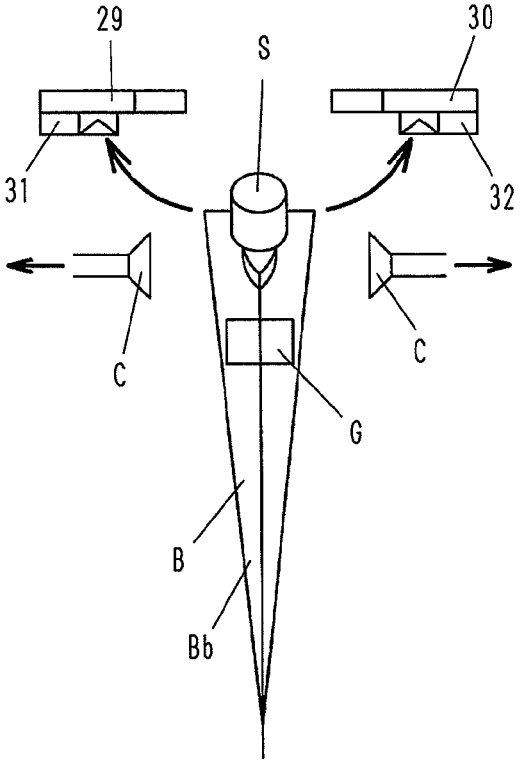

When the bag mouth M has been opened into a desired shape, the application of vacuum to the retracting suction cups C is stopped to cancel the suction-holding of the bag B by the suction cups C. Thereafter, the suction cups C continue retracting and stop at the respective mutually distant positions (FIGS. 7A, 7B and 7C). At substantially the same time as the cancellation of the suction-holding by the suction cups C, the first air cylinder 28 operates to cause the spout pinching members 29 and 30 to pivot in the respective directions opposite to the above to return to the standby positions, thus releasing the spout S from the pinch. The bag B assumes a three-dimensional configuration on the whole after the bag mouth M has been opened, and hence has increased shape retention (stiffness). Therefore, even when the spout S is released from the pinch after the bag mouth M has been opened, there is no possibility of the spout S tilting as it is before the bag mouth M is opened.

The bag B completed with the bag mouth opening operation is moved to the subsequent step (bag filling step) in the state of being held by the grippers G. At substantially the same time as the start of moving the bag B, compressed air is applied to the second air cylinder 35 to extend the rod 36, causing the first air cylinder 28, together with the spout pinching members 29 and 30, to return to the initial position.

It should be noted that, in the above-described embodiment, the interior of the second air cylinder is opened to the atmospheric pressure when the bag mouth is opened, thereby making the spout pinching members free to move in the width direction of the bag, and thus allowing the spout pinching members to move in the width direction of the bag through the bag in response to the mutually approaching movement of the grippers. However, the arrangement may be such that, when the bag mouth is opened, compressed air is introduced into the second air cylinder to move the spout pinching members in the width direction of the bag by driving force derived from the second air cylinder. The present invention may be applied to a bag filling and packaging process in which each bag is moved continuously. In this case, the spout holding device and the bag mouth opening device are moved in a predetermined section of the bag mouth opening step in synchronism with the movement of the bag while performing the bag mouth opening operation. Thereafter, the spout holding device and the bag mouth opening device are moved to return to the respective initial positions. Further, in the above-described embodiment, the bag B having the spout S attached thereto previously is fed into the grippers G of the packaging machine 1. The present invention, however, is also applicable to a bag filling and packaging machine in which a bag having no spout attached thereto is fed into the grippers of the packaging machine, and a spout is attached to the bag and sealed in the packaging machine, and thereafter, the bag mouth is opened, as disclosed in Japanese Patent No. 3,261,543 explained above in the section entitled "Background Art".

It should be noted that the present invention is not limited to the foregoing embodiments but can be modified in a variety of ways.

What is claimed is:

1. A bag mouth opening apparatus for use in a bag filling and packaging machine in which a spout bag having a spout attached to an upper edge-side portion thereof and having a bag mouth formed at an upper edge thereof adjacently to the spout is moved along a predetermined path to open the bag mouth, fill an article to be packaged into the bag, and seal the bag mouth, the apparatus comprising:

a plurality of pairs of gripping members, each pair comprising left and right gripping members movable toward and away from each other in a width direction of the bag, the gripping members gripping laterally opposite side edges of the bag in a suspended position and moving along the predetermined path;

a bag mouth opening device having a pair of suction-adhering members disposed at opposite sides of the bag and movable toward and away from each other in a thickness direction of the bag to suction-adhere to and hold opposite side walls of the bag; and a spout holding device holding the spout;

the spout holding device comprising:

a pair of spout pinching members disposed at the opposite sides of the bag and movable toward and away from each other to pinch the spout by moving toward each other;

a pinching member opening-closing device to move the pair of spout pinching members toward and away from each other; and a pinching member moving device to hold the pinching member opening-closing device at a predetermined initial position and allow the pinching member opening-closing device and spout pinching members to move in the width direction of the bag wherein:

the spout holding device holds the spout and keeps the spout upright without a tilt relative to a plane in which the bag extends; and the suction-adhering members move away from each other while suction-adhering to the opposite side walls of the bag and the pair of gripping members move toward each other permitting the pinching member moving device to allow the pinching member opening-closing device and spout pinching members to move toward the bag mouth.

2. The bag mouth opening apparatus of claim 1, wherein, when the pair of spout pinching members move from respective mutually distant standby positions to respective pinching positions to pinch the spout, at least one of the pair of spout pinching members engages the spout to correct the spout into a non-tilting position.

3. The bag mouth opening apparatus of claim 1, wherein the pinching member moving device has an air cylinder;

the air cylinder holding the pinching member opening-closing device at the predetermined initial position in the width direction of the bag;

wherein, in synchronism with start of movement of the gripping members toward each other, an interior of the air cylinder is opened to an atmospheric pressure to make the pinching member opening-closing device and spout pinching members free to move in the width direction of the bag.

4. The bag mouth opening apparatus of claim 1, wherein the plurality of pairs of gripping members are provided on an intermittently rotating rotary table at equal spaces in a circumferential direction of the rotary table.

5. The bag mouth opening apparatus of claim 4, wherein the bag mouth opening device and the spout holding device are provided at a bag mouth opening station set along the circumferential direction of the rotary table at a predetermined position among a plurality of positions at which the bag stops when the rotary table intermittently stops.

6. The bag mouth opening apparatus of claim 1, wherein the spout bag is a corner spout bag.

7. A bag filling and packaging machine comprising the bag mouth opening apparatus of claim 1, the bag filling and packaging machine further comprising:

a bag feeding device feeding bags into the gripping members;

wherein the bag feeding device feeds spout bags into the gripping members.

* * * * *